United States Patent [19]

Urby

[11] Patent Number: 4,922,737

[45] Date of Patent: May 8, 1990

[54] LOCK ARRANGEMENT

[75] Inventor: Lars O. Urby, Eskilstuna, Sweden

[73] Assignee: ASSA AB, Eskilstuna, Sweden

[21] Appl. No.: 399,508

[22] PCT Filed: Apr. 8, 1988

[86] PCT No.: PCT/SE88/00174

§ 371 Date: Sep. 20, 1989

§ 102(e) Date: Sep. 20, 1989

[87] PCT Pub. No.: WO88/08067

PCT Pub. Date: Oct. 20, 1988

[30] Foreign Application Priority Data

Apr. 10, 1987 [SE] Sweden ..... 8701517

[51] Int. Cl.[5] ..... E05B 35/08

[52] U.S. Cl. ..... 70/337; 70/432; 70/474

[58] Field of Search ..... 70/337, 338, 432, 472, 70/474, 475, 476, 478, 481, 484

[56] References Cited

U.S. PATENT DOCUMENTS

| | | | |
|---|---|---|---|
| 1,116,929 | 11/1914 | Schell | 70/343 |
| 1,639,535 | 8/1927 | Russo | 70/379 R |
| 2,188,149 | 1/1940 | Kaiser | 70/481 |
| 3,916,656 | 11/1975 | Schlage | 70/478 |
| 4,047,408 | 9/1977 | Johns | 70/129 |
| 4,068,510 | 1/1978 | Neary | 70/379 R |
| 4,437,695 | 3/1984 | Foshece | 292/169.16 |
| 4,793,166 | 12/1988 | Marks | 70/379 R |

*Primary Examiner*—Robert L. Wolfe

*Attorney, Agent, or Firm*—Sughrue, Mion, Zinn, Macpeak and Seas

[57] ABSTRACT

A lock arrangement which includes a lock casing (5), a key-operated cylinder lock (1) mounted on one side of the casing, and a knob or finger-turn mechanism (7–10) mounted on the other side of the casing, this knob or finger-turn mechanism being effective in activating a lock mechanism activator device, such as a follower (6) located in the lock casing (5), through the intermediary of a cylinder-lock dogging element (4) and a knob dogging element (8). The cylinder-lock dogging element (4) and the knob dogging element (8) are axially movable and are in end-to-end connection with one another. When the knob or finger-grip is turned to secure the lock, the knob dogging element is moved axially in a direction which causes the cylinder-lock dogging element also to move in its axial direction, to a position which prevents a standard key from being inserted fully into the cylinder lock. A specially configured management key, however, can be inserted into the cylinder lock for appropriate manipulation of the lock components.

7 Claims, 2 Drawing Sheets

LOCK ARRANGEMENT

FIELD OF INVENTION

The present invention relates to a lock arrangement of the kind which, expressed in general terms, includes a key-operated cylinder lock, which is mounted on one side of a lock housing, and a knob mechanism, which is mounted on the other side of the lock housing and by means of which a lock actuating member, such as a cylinder follower, can be manipulated through the intermediary of a dogging element.

Many different lock arrangements of this general kind are known to the art.

The invention relates particularly, but not exclusively, to locks of this kind which are intended preferably for use in hotels and like establishments, in which, in many instances, it is desirous to be able to manipulate the lock from outside the door to which the lock is fitted, with the aid of a standard pass key or guest key, and to be able to manipulate the lock from inside the door with the aid of the knob mechanism. It is also often required of such locks that when the door is locked from the inside by means of the knob mechanism, the door cannot be unlocked from the outside with the pass key or guest key. It is desirous, on the other hand, that such locks can be opened at all times with the aid of a special or so-called management key, even when the door has been locked from the inside by means of the knob mechanism.

The actual locking function of such locks will sometimes differ, although not significantly, depending upon the country from which the lock arrangement originates.

For example, the lock may sometimes include a handle-operated latch bolt and a dead bolt which is manipulated by the cylinder lock and the dead bolt mechanism.

In some cases no separate dead bolt is included in the lock, and instead the latch or catch bolt serves to lock the door automatically as the door is closed. Locks are also known with which the lock mechanism is manipulated with the aid of a key from the outside or from the inside with the aid of the knob or by further rotation of the handle.

Other types of locks having further modified locking functions are also known to the art.

Certain types of locks also include indicator means, e.g. a pin, which will indicate from outside the door whether or not the door is locked, i.e. whether the door has been locked from the outside with a key or from the inside by means of the knob.

BACKGROUND PRIOR ART

Examples of known locks of the aforesaid kind are described and illustrated in CH-A-650 054 (Berchtold), US-A-4 068 510 (Nearyl), US-A-1 639 535 (Russo), US-A-1 116 929 (Schoell) and FR-A-2 177 148 (Vachette).

None of these known lock arrangements or mechanisms, however, are constructed to prevent, with simple means, the lock from being opened with a standard key or guest key from the outside when the lock has been secured from the inside with the aid of a knob mechanism, while at the same time enabling the lock to be released from the outside with a special or management key.

OBJECT OF THE INVENTION

A prime object of the invention is to provide a simple lock arranement which will remove the aforesaid deficiency of known locks of this kind and which can be adapted readily to the many different types of lock systems and lock arrangements available on the market and where the type of lock system used is often related to that particular country or that particular part of the world in which the lock is used and to the lock traditions or "security philosophies" which prevail in the country concerned.

Another object is to provide a lock arrangement of the aforesaid kind with which a standard key can be converted, with the aid of simple means, to a special key or management key, and which is not encumbered with those drawbacks encountered with conventional master key systems, where possession of such a key by an unauthorized person would enable such a person to open all locks belonging to the system.

SUMMARY OF THE INVENTION

These and other objects are fulfilled by a lock arrangement according to the invention, which is characterized essentially in that the cylinder-lock dogging element and the knob dogging element are axially movable and are mutually in end-to-end contact in at least given positions of axial movement and in that the knob dogging element is intended, in dependence on the position to which it is rotated, these positions corresponding to the respective positions of the lock mechanism in its unlocking and locking modes, either to be located in a withdrawn position or to be located in a forwardly extended, axially locked position in which the cylinder-lock dogging element prevents full insertion of a standard key into the cylinder lock.

Thus, in accordance with the invention direct contact is established between the axially movable knob dogging element and the axially movable cylinder-lock dogging element, and the knob dogging element is enabled to take an axially immovable position in which it cannot be displaced axially by a standard key inserted into the cylinder lock, thereby preventing the standard key from being inserted fully into the lock and therewith preventing the cylinder plug from being turned by said key.

In other words this means that when the lock mechanism is brought to its locking mode with the aid of the knob on the inside of the door, the lock cannot be opened from the outside with a standard key. The same applies when the lock mechanism is brought to its locking mode from the outside with the aid of a special key or management key, since this key will also cause the knob dogging element to take the aforesaid axially immovable position and therewith render the full insertion of a standard key into the lock impossible.

A special key, or management key, which has a particularly configured end, can be inserted fully into the lock, however, in order to release or to secure the lock. This may involve rotating the knob dogging element via the lock actuating member, e.g. the follower, so that the knob dogging element is moved from its axially immovable position.

A preferred embodiment of the inventive lock is characterized in that an assembly comprising a fixed plate, a thrust plate and a spring located therebetween is mounted on the lock housing; in that the knob dogging element presents projections which are located on both sides of said assembly; in that the outer surface of the fixed plate presents a guide means, e.g. a bead, against which an edge part of one projection engages when the knob dogging element is turned to a position which corresponds to the locking mode of the lock, wherewith the projection bearing on the inner surface of the thrust plate urges the thrust plate outwards and the knob dogging element is displaced forwardly to its axially immovable position.

The aforesaid guide means, e.g. the bead, functions in the manner of a camming surface, such that when the knob dogging element is turned, the dogging-element projection will ride on the bead and therewith displace the knob dogging element forwardly, so that the dogging-element projection located on the inside of the aforesaid assembly engages the thrust plate and displaces the plate against the action of the spring lying between the two plates.

The thrust plate may be connected to an indicating device, such as a pin, which passes through a cut-out in the fixed plate and through the cylinder lock housing, and which is effective in indicating that the lock has been locked.

It is preferred in practice that the knob dogging element is provided with one or more projections in spaced relationship with the fixed plate, such that the projection or projections will pass out of contact with the guide or camming means, e.g. the bead when the knob dogging element is turned.

According to one advantageous embodiment the projections provided on the end of the knob dogging element are configured to form a cross of suitable shape for engagement with the lock actuating member, e.g. the follower. The knob dogging element is also conventionally provided inwardly of the thrust plate with two projections which lie in the plane of the dogging element. Whether the end of the knob dogging element is given cruciform configuration or is configured with a single projection depends on the type of lock concerned. In the case of lock mechanisms with which the knob or the cylinder lock key must be turned through a complete revolution in order to move the bolt to its locking position, it is normally sufficient to use a projection configuration which falls in the plane of the knob dogging element.

In other types of locks which require the knob or key to be turned through only 180° or 90°, it has been found sufficient in normal cases to provide the knob dogging element with projections which have a cruciform configuration.

These and other characteristic features of the invention will be made more apparent in the following description, which is made with reference to a number of preferred embodiments of the invention and with reference to the accompanying drawings, in which FIG. 1 is a perspective, exploded view of the lock components forming part of a lock arrangement according to the invention;

Figures 1, 2, 3, 4, 5:
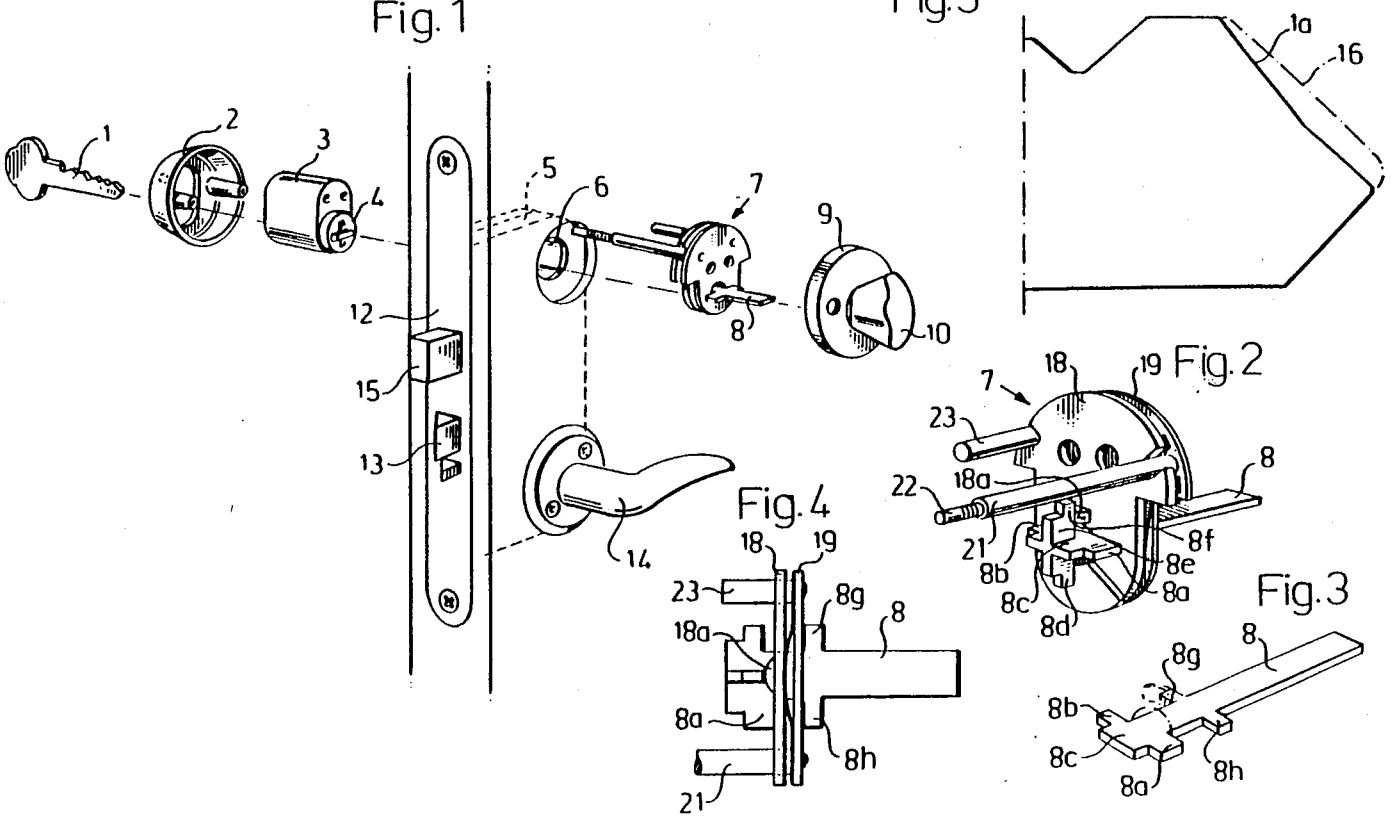
FIG. 2 is a perspective view of a fixed plate and thrust plate assembly which incorporates a cruciform projection arrangement.
FIG. 3 illustrates a knob dogging element which is provided with projections that lie in the plane of said element.
FIG. 4 is a side view of the assembly illustrated in FIG. 2.
Figure 6:
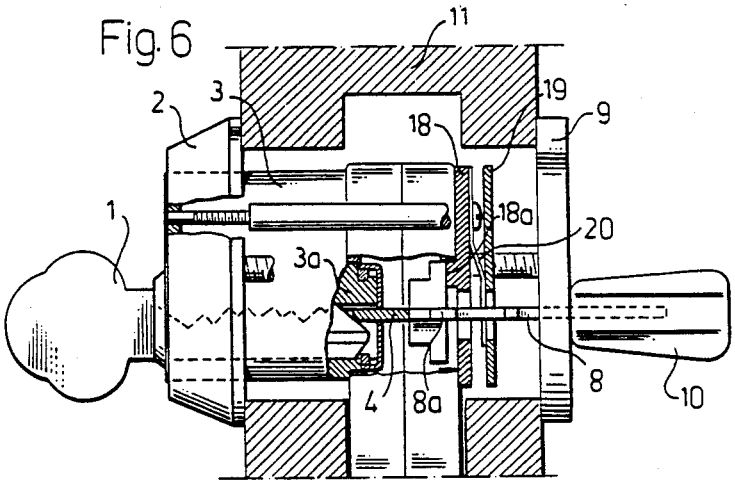
Figure 7:
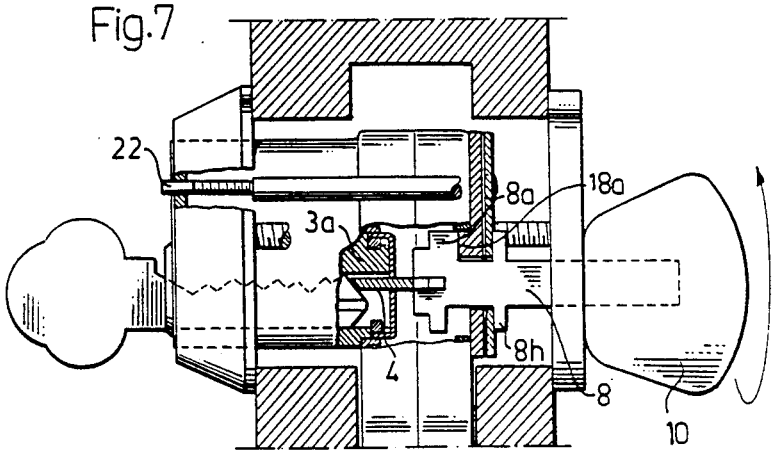
Figure 8:
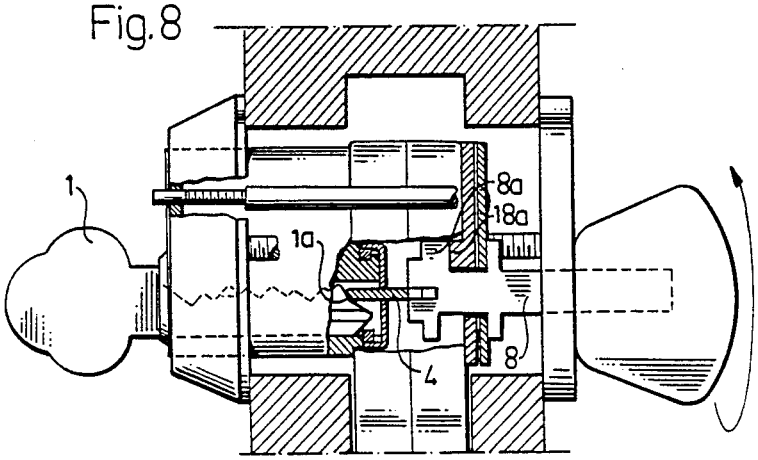

FIG. 5 illustrates schematically in full lines, and in side view, the end of a special key, or management key, intended for a lock constructed in accordance with the invention, and in chain lines the corresponding end of a standard key or guest key; and FIGS. 6 to 8 are cross-sectional views which illustrate the functioning of a lock arrangement constructed in accordance with the invention, wherein FIG. 6 illustrates the lock arrangement with a standard key or guest key inserted in the lock and with the knob mechanism in a position which corresponds to the unlocked mode of the arrangement;

FIG. 7 illustrates the functioning state of the lock arrangement of FIG.. 6 subsequent to rotating the knob to a position corresponding to the locked mode of the arrangement; and FIG. 8 illustrates the functioning of the lock arrangement in the state shown in FIG. 7, but with the standard or guest key replaced with a special key or management key.

DESCRIPTION OF PREFERRED EMBODIMENTS

The exploded view of FIG. 1 illustrates the component parts of an inventive lock arrangement. These components are: a key 1, a cylinder fitting or cylinder cap 2, a cylinder lock 3 having a dogging element 4, a lock casing or housing 5 which incorporates a follower 6 forming part of the lock mechanism, a fixed plate and thrust plate assembly 7, a knob dogging element 8 attached to the assembly 7, a knob fitting or plate 9, and a knob or finger turn 10.

The lock casing is shown fitted into a cavity in a door 11 and is provided with a face plate 12. The latch bolt 13 of the lock mechanism is manipulated with the aid of a door handle 14, while the dead bolt 15 of said lock mechanism is manipulated by means of the cylinder lock 3 and the knob or finger-turn mechanism 7–10, via the respective dogging elements 4 and 8.

The respective dogging elements 4 and 8 of the cylinder lock and the knob mechanism are both movable in an axial direction and, when the lock is assembled, are in end-to-end connection with one another. Furthermore, the knob dogging element 8 is intended to be located either in a withdrawn position or in an outwardly displaced position in which it is held against axial movement, depending upon the rotational position of the dogging element, which in turn depends upon whether the lock mechanism is in its unlocked or locked mode.

FIGS. 2 and 4 illustrate an assembly 7 which comprises a fixed plate 18, which is intended to be attached firmly to the lock casing, and a thrust plate 19 which is movable axially in relation to the fixed plate 18 against the action of an intermediate leaf spring 20. The knob dogging element 8 extends through circular holes in the fixed plate 18 and the thrust plate 19 and has mounted on its outwardly directed end either a plurality of projections which lie in the plane of said element - c.f. FIG. 3, or a plurality of projections which in addition to those projections 8*a*, 8*b*, 8*c* which lie in the plane of the dogging element also include a plurality of projections 8*d*, 8*e*, 8*f* which lie in a plane that extends perpendicularly to the plane of said dogging element, therewith to form a projecting cruciform 8*a*–8*f* as illustrated in FIGS. 2 and 4.

As will be seen particularly from FIG. 4, the knob dogging element, or driver 8, has two further projections 8*g* and 8*h*, which abut the inwardly facing surface of the thrust plate 19 and which lie in the plane of said dogging element, such as to move the thrust plate 19 axially during outward axial movement of the knob dogging element 8.

As will also best be seen from FIG. 4, the projection 8*a* is arranged to co-act with a curved, raised surface or bead 18*a* located on the fixed plate 18, such that when the knob dogging element 8 is rotated, the projection 8*a* will ride on the bead 18*a* and therewith axially displace the thrust plate 19. The thrust plate 19 of the illustrated embodiment has mounted thereon a rod-shaped holder 21 which carries an indicating pin 22, and a stop pin 23.

FIG. 5 illustrates in full lines the configuration of one end of a special key or management key 1 having an especially configured tip 1*a*, and in chain lines 16 the configuration of one end of a corresponding standard key or guest key.

FIGS. 6–8 illustrates the lock arrangement when assembled. As in the embodiment shown in FIGS. 2 and 4, the end of the knob dogging element, or driver 8 presents projections 8*a*–8*f* in the form of a cross.

FIG. 6 shows a standard key 1 inserted into the cylinder lock 3. The lock mechanism housed in the lock casing 5 is in the unlocked mode and the knob or finger-turn 10 is correspondingly in a horizontal position. The thrust plate 19 is spaced axially from the fixed plate 18 and the indicating pin 22 indicates that the lock arrangement is in its unlocked mode. The end of the knob dogging element carrying the projections is in contact with the axially movable cylinder dogging element 4 incorporated in the plug or barrel 3*a* of the cylinder lock and abuts the end of the standard or guest key 1.

FIG. 7 illustrates the position of the lock components subsequent to turning the knob 10 through 90°. The projection 8*a* has therewith displaced the dogging element 8 outwards in co-action with the bead 18*a*, while bringing the projections 8*g*, 8*h* into engagement with the thrust plate 19 and moving the plate outwards into firm abutment with the fixed plate 18.

As a result of its engagement with the outer end of the knob dogging element 8, the cylinder-lock dogging element 4 is displaced axially outwards through a distance of about 2 mm, therewith also displacing the key 1. The plug 3*a* of the cylinder lock 3 cannot then be turned with the key 1.

As will be understood, since the knob dogging element 8 in this state of the lock arrangement is held against axial movement, the lock cannot be opened with a standard key 1.

FIG. 8 illustrates the use of a special key or management key 1 which has a particularly configured end 1*a* which enables the key to be inserted in the cylinder lock and turn the plug 3*a*. The rotational movement effected by the follower (not shown) of the lock mechanism in the casing 5 when the management key is turned will result in rotation of the knob dogging element 8 and the knob or finger-turn 10.

The FIGS. 7 and 8 show the indicating pin 22 in a position in which it indicates that the lock arrangement is in its locking mode.

When the knob 10 is turned back to the position shown in FIG. 6, in which the projection 8*a* no longer rides on the bead 18*a*, the knob dogging element 8 is moved back to the FIG. 6 position by the spring 20 located between the fixed plate 18 and the thrust plate 19, thereby enabling the cylinder-lock dogging element 4 to be manipulated with a standard key 1, which can be inserted into the lock and into contact with the outer end of the knob dogging element.

Industrial Application

It will be understood from the aforegoing that the invention can be applied to many different types of lock construction, such as to prevent a lock from being opened with a standard key or guest key when a door has been locked from the inside with the aid of the knob or the finger-turn, or from the outside with the aid of a special key or management key, and such as to enable the door to be unlocked from the outside with the aid of said special key or management key.

The inventive lock mechanism can be swiftly unlocked from the inside under all circumstances, for instance if the need arises to vacate the room quickly, e.g. in the event of fire.

The above description also teaches the provision of a management key for the inventive lock arrangement.

I claim:

1. A lock arrangement which includes a lock casing (5), a key-operated cylinder lock (1) mounted on one side of the casing, and a knob or finger-turn mechanism (7–10) mounted on the other side of the casing, said knob or finger-turn mechanism being effective in activating a lock-mechanism activator device, such as a follower (6) located in the lock casing (5), through the intermediary of a cylinder-lock dogging element (4) and a knob dogging element (8), characterized in that the cylinder-lock dogging element (4) and the knob dogging element (8) are axially movable and are in end-to-end connection with one another at least in given positions of axial movement; and in that the knob dogging element (8) is intended to be located, depending on whether said knob dogging element is rotated to a position corresponding to the locked mode or the unlocked mode of said lock mechanism, in either a withdrawn position or an outwardly projected position in which the knob dogging element is held against axial movement and in which the cylinder-lock dogging element (4) will prevent a standard key (1) which fits the cylinder lock (3) from being inserted fully into said cylinder lock.

2. A lock arrangement according to claim 1, characterized by a special key or a management key having a particularly configured end or tip (1*a*) which allows the key to be inserted fully into the cylinder lock (3), so as to lock or unlock the lock mechanism, when the knob dogging element is located in said positions.

3. A lock arrangement according to claim 1 or claim 2, characterized in that the lock casing (5) has mounted therein an assembly (7) which comprises a fixed plate (18), a movable thrust plate(19)and spring (20) located between said plates; in that the knob dogging element (8) presents projections (8*a*–8*c*; 8*g*; 8*h*) located on respective sides of said assembly (7); in that the fixed plate (18) has provided on the outer surface thereof means, e.g. a bead (18*a*), against which an edge part of one projection (8*a*) engages during movement of the knob dogging element (8) to its position which corresponds to the locking mode of the lock mechanism, such that the projection (8*g*; 8*h*) located on the inward side of the thrust plate (19) will urge the thrust plate outward and the knob dogging element will be moved to its forwardly displaced, axially fixed position.

4. A lock arrangement according to claim 3, characterized in that the lock dogging element presents one or more additional projections (8*d*–8*f*) which are spaced from said means (18*a*) on the fixed plate so that said projection or projections will pass free of said means, e.g. the bead (18*a*), during given rotation of the knob dogging element (8).

5. A lock arrangement according to claim 4, characterized in that the knob dogging element (8) presents at one end a cruciform arrangement of projections (8*a*–8*f*) intended for engagement with the lock mechanism activating device, e.g. the follower (6).

6. A lock arrangement according to any of of claim 3 characterized in that the thrust plate (19) carries a holder (21) for a lock-made indicating pin (22).

7. A management key intended for a cylinder lock (3) forming part of a lock arrangement according to claim 6 characterized in that the key bit has a particularly configured tip (1*a*).

* * * * *